United States Patent [19]

Harle

[11] Patent Number: 5,040,294

[45] Date of Patent: Aug. 20, 1991

[54] PROCESS FOR PRODUCING A CAMSHAFT

[75] Inventor: Hans A. Harle, Bopfingen, Fed. Rep. of Germany

[73] Assignee: Schwabische Huttenwerke GmbH, Fed. Rep. of Germany

[21] Appl. No.: 471,059

[22] Filed: Jan. 29, 1990

Related U.S. Application Data

[63] Continuation of Ser. No. 263,707, Oct. 28, 1988, abandoned.

[30] Foreign Application Priority Data

Oct. 28, 1987 [DE] Fed. Rep. of Germany ..... 3736453

[51] Int. Cl.[5] ..... B23C 3/08

[52] U.S. Cl. ..... 29/888.1; 29/6.01; 29/888.08; 29/888.09; 72/76; 72/367; 72/371; 72/402

[58] Field of Search ..... 29/6.01, 888.08, 888.09, 29/888.092, 888.1; 72/76, 367, 370, 402; 74/567

[56] References Cited

U.S. PATENT DOCUMENTS

| | | | |
|---|---|---|---|
| 2,472,261 | 6/1949 | Mueller | 29/6 |
| 2,653,373 | 9/1953 | Brauchler | 29/6 |
| 2,892,254 | 6/1959 | Garvin | 29/6 X |
| 4,269,551 | 5/1981 | Kralowetz | 29/6 X |
| 4,416,130 | 11/1983 | Judge, Jr. | 72/76 X |
| 4,464,917 | 8/1984 | Kienhöfer | 72/76 |
| 4,612,695 | 9/1986 | Umeha et al. | 72/367 X |
| 4,763,503 | 8/1988 | Hughes et al. | 72/367 X |

FOREIGN PATENT DOCUMENTS

| | | | |
|---|---|---|---|
| 3528464 | 2/1987 | Fed. Rep. of Germany . | |
| 651860 | 4/1951 | United Kingdom | 29/6 |

OTHER PUBLICATIONS

"Rotary Swaging of Bars and Tubes" vol. 4, Metals Handbook, American Society for Metals, pp. 333-346, 1969.

*Primary Examiner*—Timothy V. Eley
*Assistant Examiner*—Peter Dungba Vo
*Attorney, Agent, or Firm*—Davis, Bujold & Streck

[57] ABSTRACT

In a process for producing a camshaft provided with bearings and cams from a pipe or from a blank having an initial oval cam shape, the configuration of the camshaft with the cams and the bearings is molded into the pipe or hollow blank by swaging and circular kneading with tool segments. In a first step, a cam shape blank (9) is brought in the area of the bearings (13) to an at least approximately circular shape by forging or hammering of the camshaft in a pre-formation. Then in a second step the configuration of the camshaft with cams (16) and bearings (13) is molded by hammering a circular kneading with tools elements that at least partly surround the blank and exert radial compressive forces thereon while changing its initial shape and oval cross section.

9 Claims, 2 Drawing Sheets

PROCESS FOR PRODUCING A CAMSHAFT

This is a continuation of copending application Ser. No. 07/263,707 filed on Oct. 28, 1988, now abandoned.

The invention concerns a process for producing a camshaft provided with bearings and cams from a pipe or from a blank having a cam shape, and a camshaft produced accordingly, wherein the configuration of the camshaft with the cams and the bearings is molded in the pipe or blank by swaging or circular kneading with tool segments that at least partly surround the blank and exert radial compressive forces thereon while, at the same time, change the shape and cross section of the blank.

Camshafts are generally produced from a workpiece together with the bearings and the cams situated on a base such as by casting or forging. Relatively time-consuming and expensive machining is associated with this production. Thus, the camshafts must be ground, the cams must be hardened, and the camshaft be balanced at the end. Together with the high cost, it is also disadvantageous that a camshaft of this kind consists of solid material and therefore is relatively heavy. But the automobile industry increasingly needs lighter camshafts.

For this reason it has already been proposed to use, as a base, a pipe upon which the sintered cams are situated. This kind of production is also relatively expensive and still has not brought the desired success.

In DE-OS 35 28 464, a process for producing a camshaft has been described wherein a pipe having an external periphery equal to or larger than the bearing sections and/or the cams is used and shaped by swaging. Together with a circular symmetric pipe, a pipe already drawn in cam shape has also been proposed as a blank.

However, it has now appeared in the practice that such a manufacturing process cannot materialize. During the circular kneading it was thus necessary to internally and externally counterhold. But the stresses that occur here are too great and the dimensions too small. Besides, considerable problems would arise when taking out the dollies, since they cannot be removed over the narrow points of the camshaft bearing. During circular kneading or swaging of a blank into oval or cam shape, the hammer for shaping the round bearings always hits the elevated cam point first whereby an uncontrolled molding would occur in the area of the bearings. The pipe can bulge and in some cases even flange. Besides, the blank would bend in this area due to the one-sided striking thereupon and this would lead to considerable problems.

Therefore, this invention is based on the problem of providing a process of the kind mentioned at the beginning in which the above problems do not occur, and especially according to which camshafts of greater strength and high precision can be produced at low cost.

According to the invention, this problem is solved by the fact that a cam shaped blank is, in a first step, brought to a pre-formation of an at least approximately circular shape by forging or hammering in the area of the bearings of the camshaft and then, in a second step, the configuration of the camshaft with the cams and the bearings is molded by swaging or circular kneading with tool elements that at least partly surround the blank and exert radial compressive forces thereon, while changing its shape.

One of the essential features of the invention consists now in that due to the pre-forming a substantially uniform circular kneading or swaging can be effected in the area of the bearings. The hammering tools can engage practically the whole periphery so that no bendings or one-sided stress can occur. It is essential that due to the pre-forming of the blank, an at least approximately circular cross section is obtained in the area of the bearings.

Said pre-forming can be carried out in any manner desired, the pre-forming being effected generally in a hot state for simplification and better molding. The pre-forming is advantageously carried out in a manner such that the diameter obtained is somewhat larger than the final diameter of the bearings. In the swaging and circular kneading that follows, the final diameter of the bearings is very accurately produced. The cams are likewise brought exactly to correspond to the measurements, the displaced material entering either in the wall thickness or in the length of the cam shaft, a combination being also possible.

In some cases it is not necessary that the whole blank be heated. A partial heating, in the area of the bearings to be pre-formed, is optionally sufficient. Forging presses or forging hammers can be used for this purpose.

The blank in cam shape can be prepared from a pipe transformed to cam shape by pressing.

A blank with an external diameter somewhat larger than the largest diameter or cross section of the finished camshaft can be advantageously used. This especially applies to the cam area.

In order than an optimal saving of weight be obtained, it can be provided that the diameter ratios and the molding forces be harmonized in a manner such that, together with a hollow pipe with hollow bearings, the cam also remains at least partly hollow in the interior.

The cam shaped blank is molded, during the circular kneading, to form the cams which are all aligned in a single row and lie in one plane, after which, in a third step, the camshaft is subjected to a twisting operation to rotate the cams into the desired positions.

In comparison with a compact forged or cast camshaft, a weight reduction of up to 50% can be obtained. Another advantage consists in that the camshaft produced according to the invention shows less consequences related to an imbalance of measurement.

Despite its light weight and its production from a pipe, the camshaft is relatively rigid and resistant to distortion after its formation. It has actually been found that a reinforcement material precisely in the areas especially important to stressed is obtained by circular kneading or swaging.

Another great advantage resulting from the circular kneading, according to the invention, is that the molding of the camshaft can be easily adapted to the specific requirements. Thus, for instance, the sides of the cam can be provided with a better transition to the camshaft. In the process according to the invention, unlike in a chip-removing machining of a camshaft, there is no engaging of the grain flow.

By virtue of the circular kneading and, in particular, the swaging, an improvement of the material is obtained whereby it is optionally possible to use a simpler and thus cheaper material as the starting material for the camshaft, which subsequently acquires greater hardness or strength by processing.

The production process according to the invention is herebelow described in principle with reference to the drawing.

In the drawings:

FIG. 1: diagrammatically shows a tool for producing a camshaft;

Figure 4:
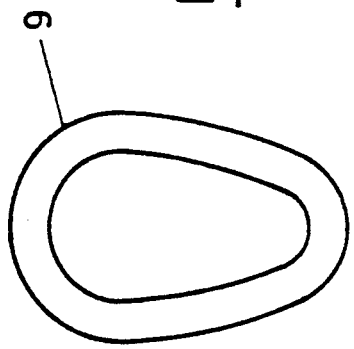
FIG. 4 is a front view of a cam shape.

A blank 9 in cam oval shape such as shown in FIG. 4, serves as the starting material. The blank in said shape can be produced, for instance, from a pipe having a circular cross section that is transformed into cam shape, for instance, by pressing. Both a seamless and a soldered pipe can be used as the blank. But obviously a blank produced in any manner desired which already at the start has the shape of a cam can also be used.

In a first process step, the blank with cam shape is now preformed in the places where the bearings of the camshaft are to be situated or on which said bearings are to be molded. By only a partial hearing in this area, the cam shape is optionally transformed on the bearings by a two-part drop hammer into a diametrically circular shape. This transformation can likewise be obtained by hot forging.

The swaging and circular kneading then follows in a second step.

The working process, the transforming operation and the functional principle of the circular kneading, which is a free molding for cross section reduction in bars and rods with two or more tools that wholly or partly encircle the cross section of a workpiece to be reduced, are generally known and therefore will be only briefly described below. At the head of a hammer shaft 1 there are slot-shaped recesses that serve to accommodate the actual hammering tool 2. The hammering tools are moved via a push rod 4 with compensating plates 3 therebetween. The hammer stroke required for molding the blank 9 results by a magnification to a rolling path 5 of the push rod 4.

A roller cage 6 is freely rotatably situated between the hammer shaft 1 and an external guard ring 8. Compression rollers 7 are placed in receiving bores of the roller cage 6. Upon rotating hammer shaft 1, the hammering tools 2 are now guided outwardly by centrifugal force via the push rod 4. In case of a stationary or slowly rotating hammer shaft, the opening movement can also be assumed by springs.

In a rotating hammer shaft, the push rods 4 roll down with their rolling path 5 on the compression rollers 7 and thus transmit to the roller cage 6 a relative movement in the same direction of rotation, but accordingly slower than the hammer shaft itself. Each time the push rod 4 passes beneath a compression roller 7 a radially inward pressure pulse results that itself is transmitted as a molding force to the hammering tools 2 and thus to the workpiece.

In another embodiment, the guard ring 8 can rotate and the hammer shaft 1 either staying still or being driven at slow speed in the same or in an opposite direction. The tool type and configuration are oriented toward the specific use and to the kind of workpiece to be processed, which in the instant case is a camshaft.

Figure 1:
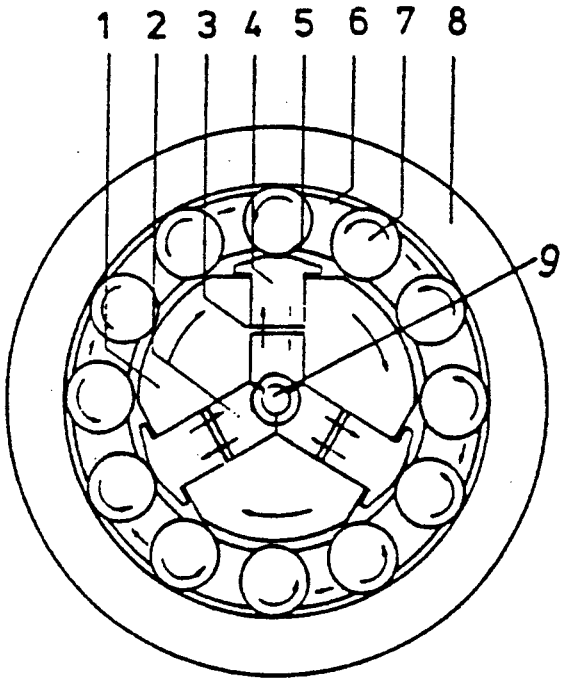
Figure 2:
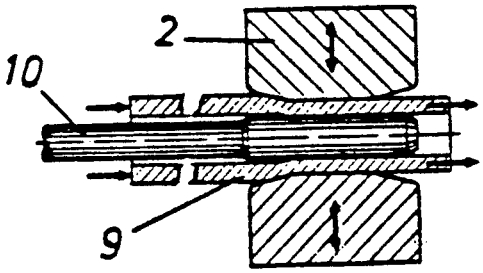
FIG. 2 is an enlarged longitudinal section (as cutout) with two tools and one blank.

In FIG. 2, a pre-formed blank 9 in the interior of which a spindle 10 can be situated, when needed, is basically shown.

The workpiece is here introduced in an axial direction between the hammering tool 2.

Due to the fact that with the circular kneading in the area of the bearings a circular diameter already exists as result of the pre-forming, it is also possible in this area to obtain a hammering and circular kneading into the desired shape with the advantages resulting therefrom.

Figure 3:
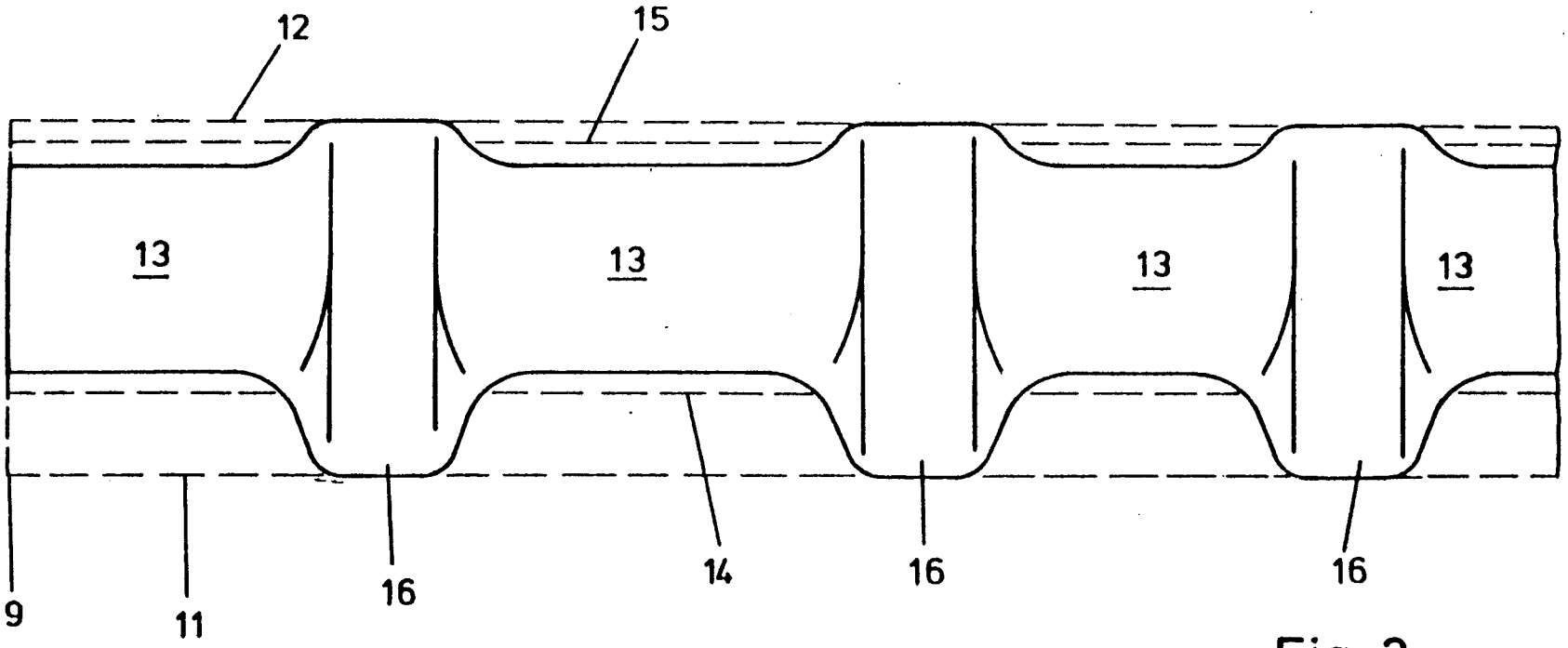
FIG. 3 is a sideview of a camshaft.

In FIG. 3, the separate process steps are shown with reference to a sideview of a camshaft (as cutout).

Starting from a blank 9, such as shown in FIG. 4, and having a cam shape (see both outer dotted lines 11 and 12), a transformation of the cam shape in the area of the bearings 13 is effected in a first step until obtaining a diameter slightly larger than the final diameter of the bearings. The enlarged diameter is shown by the dotted lines 14 and 15. The drawn lines of the camshaft constitute the final diameter or final cross section. When the blank 9 in cam shape has a slightly larger diameter than the largest diameter or cross section of the finished camshaft, both dotted lines 11 and 12 are optionally still somewhat outside the cams 16, which in this case are kneaded to the final diameter in the drawn out line.

Pre-forming in the indicated sense can optimally be effected also for parts of the camshaft situated between the bearings 13 and the cams 16 and which likewise must have a round cross section in the final state.

I claim:

1. A process for producing a camshaft having at least one cam and at least one bearing formed in a blank by swaging and circular kneading with tool elements that at least partially surround the blank and exert radially compressive forces thereon to change an initial shape and cross-section of the blank, said process comprising the steps of:

using an elongate hollow blank, having a longitudinal axis and an initial oval cross-section normal to said axis having an oval exterior surface generally defining a desired cam profile, as a starting material;

forming at least one bearing of approximately circular cross-section in a portion of said oval hollow blank by one of forging and hammering; and molding by swaging and circular kneading said oval hollow blank thereby producing said at least one cam with tool elements that at least partially surround said oval hollow blank, said tool elements exerting radially compressive forces to other portions of said oval hollow blank thereby changing the initial shape and the cross-section of said oval hollow blank into a finished form of said camshaft.

2. A process according to claim 1, further comprising carrying out the forming step in a hot state.

3. A process according to claim 1, in which a diameter of said at least one bearing, obtained by said forming step, is larger than a final diameter of said at least one bearing.

4. A process according to claim 1, in which said oval blank is formed from a pipe transformed into oval shape by pressing.

5. A process according to claim 1, further comprising using a hollow pipe, and harmonizing diameter ratios and molding forces in a manner such that said at least one bearing and said at least one cam remain partially hollow.

6. A process according to claim 1, in which at least to two cams are molded by swaging and circular kneading.

7. A process according to claim 6, further comprising twisting said camshaft in order to rotate at least one of the cams to a desired position.

8. A process for producing a camshaft having at least one cam and at least one bearing formed in a blank by swaging and circular kneading with tool elements that at least partially surround the blank and exert radially compressive forces thereon to change an initial shape and cross-section of the blank, said process comprising the steps of:

using an elongate hollow blank, having a longitudinal axis and an initial oval cross-section normal said axis having an oval exterior surface generally defining a desired cam profile, as a starting material;

forming at lest one bearing of approximately circular cross-section in a portion of said hollow blank by one of forging and hammering; and molding by swaging and circular kneading said hollow blank thereby producing said at least one cam with tool elements that at least partially surround said hollow blank, said tool elements exerting radially compressive forces to other portions of said hollow blank thereby changing the initial shape and the cross-section of said hollow blank into a finished form of said camshaft;

wherein said hollow blank has an external diameter that is larger than a final diameter of said finished camshaft.

9. A process for producing a camshaft having at least two cams and at least one bearing formed in a blank by swaging and circular kneading with tool elements that at least partially surround the blank and exert radially compressive forces thereon to change an initial shape and cross-section of the blank, said process comprising the steps of:

using an elongate hollow pipe, having a longitudinal axis and an initial oval cross-section normal to said axis having an oval exterior surface generally defining a desired cam profile, as a starting material;

forming at least a portion of said hollow pipe into one bearing of approximately circular cross-section by one of forging and hammering; and molding by swaging and circular kneading said hollow blank thereby producing said at least two cams with tool elements that at least partially surround said hollow pipe, said tool elements exerting radially compressive forces to other portions of said hollow blank thereby changing the initial shape and the cross-section of said hollow pipe into a finished form of said camshaft.

harmonizing diameter ratios and molding forces in a manner such that said at least one bearing and said at least two cams remain partially hollow in the finished said camshaft, and twisting said finished camshaft in order to rotate at least one of the two cams to a desired position.

* * * * *